United States Patent [19]

Chamberlin

[11] 4,311,116

[45] Jan. 19, 1982

[54] IN-MOTION STARTING GATE

[76] Inventor: David A. Chamberlin, P.O. Box 1243, Reseda, Calif. 91335

[21] Appl. No.: 172,700

[22] Filed: Jul. 28, 1980

[51] Int. Cl.[3] ..... A63K 3/02

[52] U.S. Cl. ..... 119/15.5 A

[58] Field of Search ..... 119/15.5, 15.5 A

[56] References Cited

U.S. PATENT DOCUMENTS

| | | | |
|---|---|---|---|
| 2,273,493 | 2/1942 | McMillan | 119/15.5 |
| 2,526,060 | 10/1950 | Ashton | 119/15.5 A |
| 2,808,026 | 10/1957 | Georgette et al. | 119/15.5 |
| 3,994,353 | 11/1976 | Greene | 180/242 |
| 4,219,094 | 8/1980 | Sturgill | 180/242 |

*Primary Examiner*—Hugh R. Chamblee

*Attorney, Agent, or Firm*—Seed, Berry, Vernon & Baynham

[57] ABSTRACT

An in-motion starting gate, particularly for horse racing tracks, is disclosed in which the horses are in uniform motion in the stalls at the starting gate at the time they are released. A lightweight starting gate, manufactured from tubular steel and/or aluminum, is supported above the ground by hydraulically powered wheels at each of the four corners, the wheels adapted to be turned in any direction. Each of the wheels is hydraulically driven through power means mounted on the gate structure. An operator station is also provided on the gate structure. Opening and closing of the gates is also hydraulically controlled.

12 Claims, 8 Drawing Figures

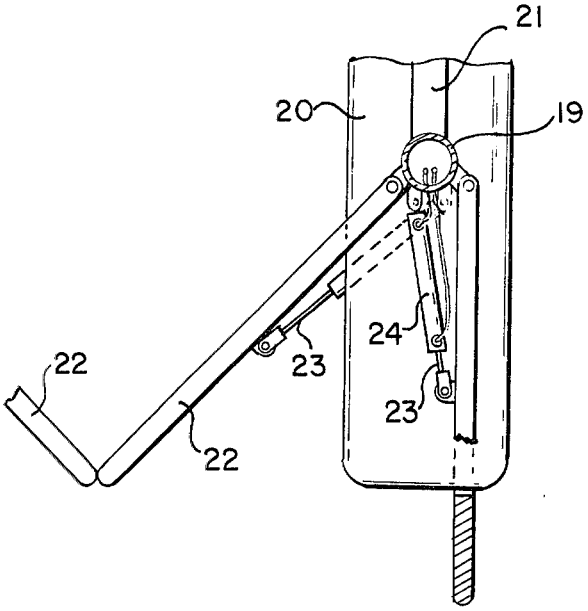
FIG. 4
FIG. 6
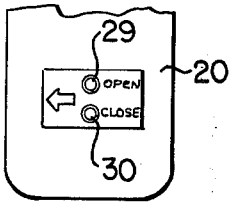
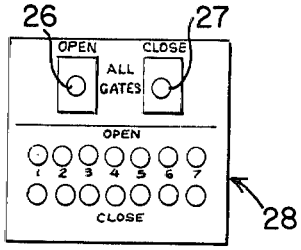
FIG. 5
FIG. 7
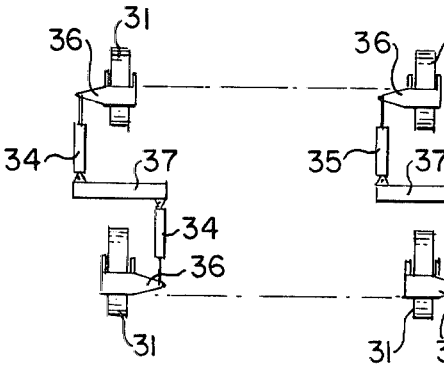
FIG. 8
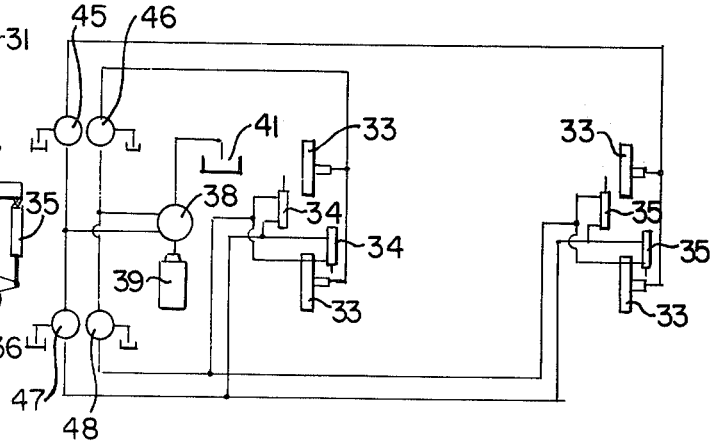

IN-MOTION STARTING GATE

BACKGROUND OF THE INVENTION

1. Field of the Invention

This invention relates to an in-motion starting gate, particularly useful for horse racing.

2. Prior Art Relating to the Disclosure

With the exception of sulkey racing, the horses in a horse race are generally started from a standstill. It is difficult to maintain a group of high-strung, nervous race horses at a standstill in a starting gate for any length of time. For that reason there are many aborted starts. The concept of starting horses with an in-motion starting gate in which the horses are in motion at the time they are released from the starting gate is known; however, such in-motion starting gates have not been entirely satisfactory. U.S. Pat. Nos. 2,793,613 and 2,808,026 disclose in-motion starting gates wherein side-by-side stalls of the starting gate are carried by a stationary frame structure. The stalls are movable relative to the stationary frame structure a short distance in the direction the horses are to run. Movement of the stalls puts the horses positioned in the stalls in uniform motion at the time of release. U.S. Pat. No. 2,556,531 discloses a gate pivotally mounted to a vehicle and a hydraulic system for swinging the gate about its pivotal connection to the vehicle.

U.S. Pat. No. 2,150,828 discloses a starting gate for horses wherein the gate is pivotally secured to a tractor moving alongside the track. U.S. patent application Ser. No. 017,150 filed Mar. 2, 1979, entitled "Starting Gate", filed in the name of the inventor hereof, also discloses an in-motion starting gate wherein the gate is pivotally connected at one end to a fifth-wheel power means for moving the gate, the power means including outriggers mounted to extend into contact with the frame and to maintain the gate from pivoting about its connection to the vehicle so that when the vehicle is moved, the frame structure of the gate is moved along with the vehicle and in the same direction but at right angles thereto.

SUMMARY OF THE INVENTION

The primarily object of this invention is to provide an in-motion starting gate, particularly for horse racing, which contains its own power source and is capable of being moved straight down the track and on and off the track without use of a separate vehicle.

It is a further object of this invention to provide an in-motion starting gate wherein the gate is supported above the ground on hydraulically driven wheels which are hydraulically steered.

It is another object of this invention to provide an in-motion starting gate which can be moved on and off the track easily after each start.

It is another object of this invention to provide a starting gate for horses wherein the gates to the stalls for the horses are hydraulically controlled and can be quietly opened and closed from a central control unit, thereby not disturbing the horses in the stable.

It is a further object of this invention to provide a starting gate which may be electrically powered.

These and other objects are accomplished by mounting hydraulically driven wheels to support the frame structure of the gate which stretches above and across the width of the track. Each of the hydraulically powered wheels is connected to a central power source. Control means are mounted on the vehicle to enable an operator to move the gate on and off the track easily or down the track for starting the horses. The gates of each of the stalls are also hydraulically operated and controlled.

BRIEF DESCRIPTION OF THE DRAWINGS

FIG. 4 is a partial plan view of one of the stall gates shown in both the open and closed positions;

FIG. 5 is a view of the control station for controlling opening and closing of the gates of each of the stalls;

FIG. 6 is a view of controls mounted at the rear end of each of the stalls, allowing the person aiding the jockey to position the horse in the stall, to open and close the rear gates of the stall in which the horse is to be positioned;

FIG. 7 is a schematic of the hydraulically operated steering means for the starting gate; and FIG. 8 is a schematic of the hydraulic system for driving the steering the wheels of the gate.

DESCRIPTION OF THE PREFERRED EMBODIMENTS

Figure 1:
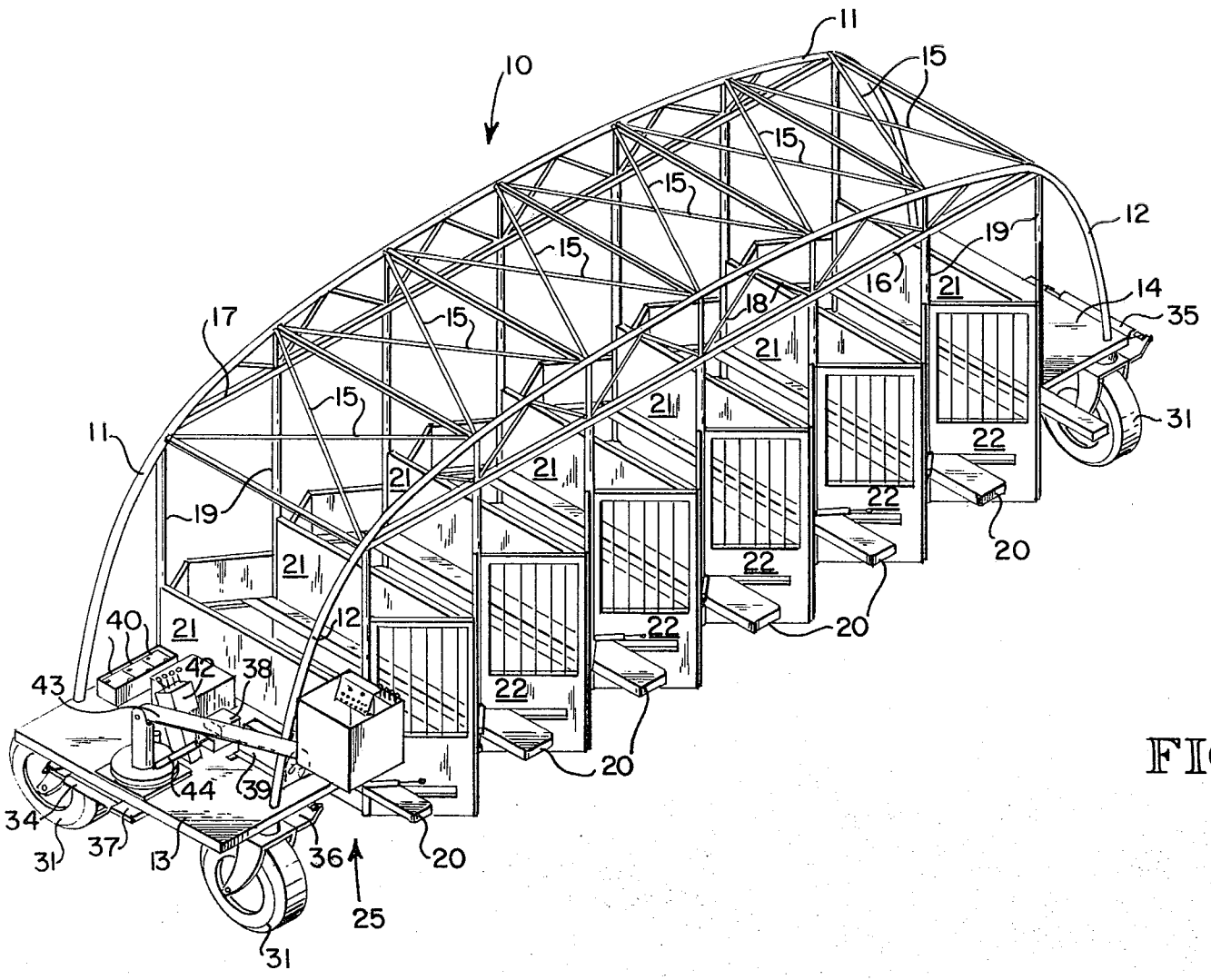
FIG. 1 is a perspective view of the starting gate of this invention.

The frame structure 10 of the gate is preferably manufactured from tubular steel and/or aluminum so that it is light in weight. The frame structure illustrated in FIG. 1 is only one of many designs which may be used and is made primarily of suitable tubular members welded together. Parallel arcuate members 11 and 12 extend the length of the gate between horizontally oriented platforms 13 and 14 at each end of the gate to which the respective ends of the members 11 and 12 are secured. The parallel members 11 and 12 are connected together by suitable cross-bracing 15.

The individual stalls for the horses are supported from horizontally oriented beams 16 and 17 secured at their respective ends to the arcuate members 11 and 12, and intermediate their ends to the arcuate members 11 and 12 by suitable cross-bracing 18.

Each of the stalls includes parallel vertical supports 19 secured at their upper ends to the beams 16 and 17. Respective platforms 20 of a width to allow a person to stand on them within the stall are secured to the lower ends of the vertical supports, as shown best in FIG. 1. The respective sidewalls 21 of each of the stalls are preferably fabricated from stainless steel or polished aluminum to prevent injury to the horse or rider when making contact with the sidewalls. Each of the stalls is provided at the front and rear with suitable gates 22 and with hydraulically powered means for opening and closing the gates. Each gate 22 is mounted to pivot about its connection to the respective vertical supports 19. Each gate 22 also has the piston 23 of a hydraulic cylinder 24 secured thereto, as illustrated in FIG. 4, the cylinder being mounted to pivot about the respective vertical supports 19. Retraction of the piston associated with each gate opens the gate to the position shown in FIG. 4, while extension closes the gate. The controls 26 (see FIG. 5) for opening and closing of the front gates of each stall are located in the starter's box 25 (see FIG. 1). The starter's box is secured to one end of a boom 13 which can be raised or lowered by hydraulic cylinder 44. The boom is secured at one end to platform 13. The starter may open and close all of the gates at one time by depressing buttons 26 and 27, respectively, or open and close individual gates by depressing desired buttons on the panel 28. The buttons or switches 26, 27 and 28 are operatively connected, through suitable valve actuators, to the respective cylinders controlling the gates.

Figure 2:
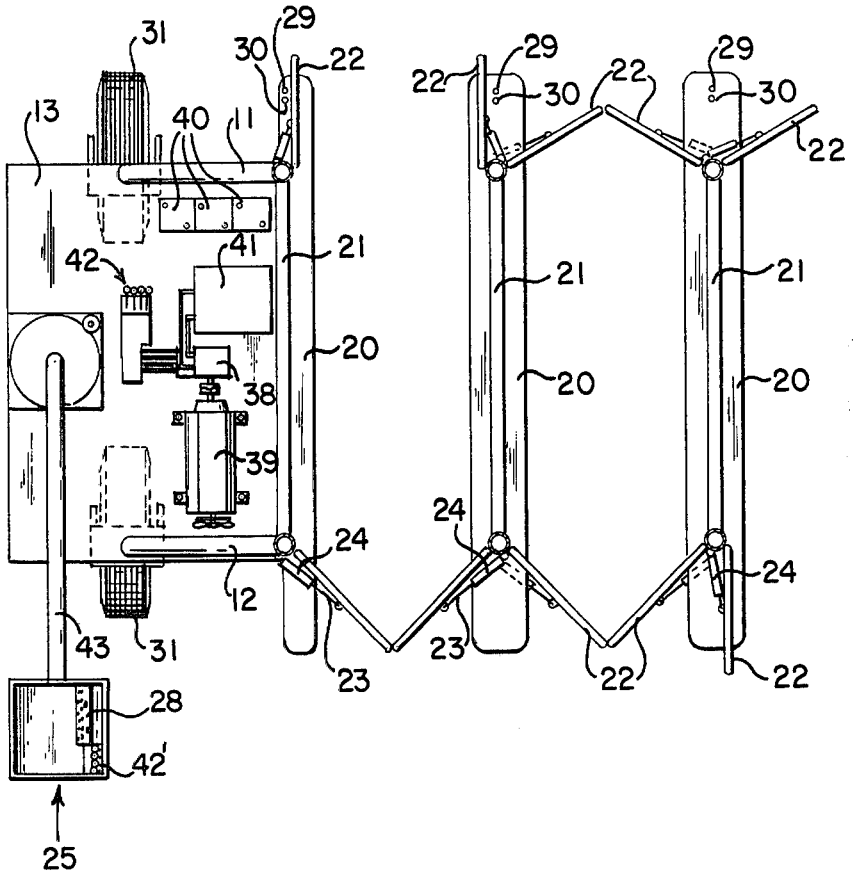
FIG. 2 is a plan view along line 2—2 of FIG. 3 of a portion of the gate of FIG. 1, illustrating the power platform and operator's control station.

Opening and closing of each of the rear gates of each stall are controlled by actuators 29 and 30 (see FIG. 6) located on the rear edges of each of the platforms 20 (see FIG. 2). The gates are best controlled by the person helping the horse and rider get into the stall.

Figure 3:
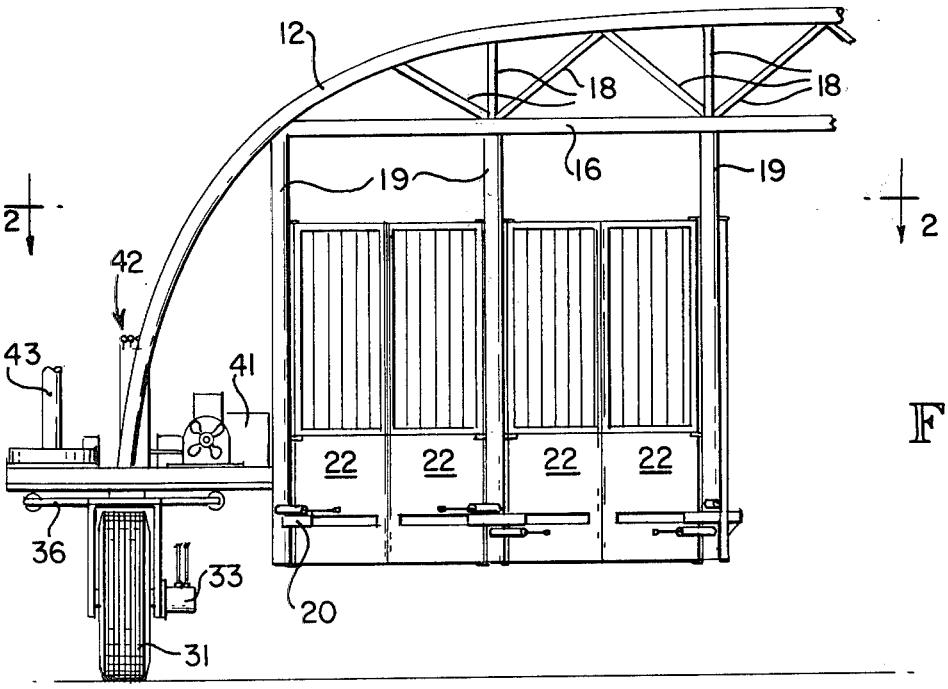
FIG. 3 is a front view of the portion of the gate shown in FIG. 2.

The frame of the gate is supported off the ground by wheels 31 mounted at each of the four corners thereof. Referring to FIGS. 3 and 7, each of the wheels is pivotally mounted to shafts 32 supported from platforms 13 and 14. Each of the wheels is preferably fitted with inflated rubber tires and may be provided with suitable shock-absorbing means, either hydraulic or pneumatic, as may be desired. Each of the wheels is operatively connected to and directly driven by a hydraulic motor 33 (see FIG. 3). Hydraulic motors, such as the Char-Lynn hydraulic motor manufactured by the Eaton Corporation, may be employed. The pairs of wheels at each end of the gate are hydraulically steered by respective pairs of hydraulic cylinders 34 and 35, whose pistons are pivotally secured to the ends of flanges 36 extending from the mounts for each of the wheels. The cylinders are pivotally secured to members 37 secured to the underside of platforms 13 and 14.

Referring to FIG. 1, a hydraulic pump 38 is powered by an internal combustion engine or, preferably, an electric motor 39 powered by storage batteries 40. Oil or other fluid for powering the hydraulic system is stored in reservoir 41. If powered by an electric motor, operation of the gate is virtually noiseless and, therefore, does not disturb the horses as they are being positioned in the stalls. Likewise, hydraulic operation of each of the gates is much less noisy than the spring-mounted gates conventionally used so that the horses are not distracted or scared. Movement of the gate may be controlled by an operator from platform 13 by controls 42 located on the platform or by the starter employing a duplicate set of controls 42' located in the starter's box 25.

Referring to FIG. 8, controls 42 and 42' control valves 45, 46, 47 and 48 to allow independent driving and steering of the respective pairs of wheels located at each end of the gate structure. The operator can thus move the gate parallel to the length of the race track, pivot one end of the gate by driving only one pair of wheels, remove the gate from the track at any angle thereto, or otherwise position the gate. The speed of the gate is controlled by varying power delivered to the hydraulic motors 33 driving each of the wheels.

The gate provides a lightweight, versatile structure for starting horses which has many advantages over those in present use.

The gate may be propelled, if desired, by individual electric motors associated with each of the wheels, with each of the motors controlled by suitable conventional electrical controls.

I claim:

1. An in-motion starting gate adapted to be positioned across a race track and then moved in its entirety along the length dimension of the track and removed from the track, comprising:

a supporting frame structure for the gate;

a series of side-by-side stalls, each having respective forward and rear gates which are pivotally mounted to open and close, carried by the supporting frame structure;

wheels pivotally mounted at or near each end of the frame structure of the gate supporting and guiding the frame structure for the gate;

hydraulically driven motors drivingly engaging the wheels;

hydraulic steering means;

power means, mounted on the frame, operatively connected to and supplying hydraulic power to the motors and the steering means; and control means operatively connected to the hydraulic motors for controlling the movement and the speed of the wheels and connected to the steering means for controlling the direction of the wheels.

2. The in-motion starting gate of claim 1 wherein the hydraulic motors drivingly engage the wheels at positions adjacent the wheels themselves.

3. The in-motion starting gate of claim 1 wherein the wheels are pivotable in any direction.

4. The in-motion starting gate of claim 1, including hydraulically operated forward and rear gates and control means controlling opening and closing of the gates.

5. The in-motion stating gate of claim 1 wherein the power means includes a hydraulic pump and an electric motor driving the pump.

6. The in-motion starting gate of claim 1, including an operator's box positioned on one end of an adjustable boom secured to the frame structure for the gate, and control means in the box for opening and closing the gates and for moving and steering the frame structure of the gate.

7. The in-motion starting gate of claim 1 wherein controls for each of the rear gates are positioned adjacent each of the rear gates to allow a person aiding a horse and rider to enter the stall to open and close the rear gate.

8. The in-motion starting gate of claim 1 wherein the supporting frame structure includes respective end support members supporting the wheels, parallel arcuate members spanning the length dimension of the gate secured at their respective ends to the end support members, and cross-bracing extending between and connecting the arcuate members, the stalls suspended from the arcuate members.

9. An in-motion starting gate, comprising:

a supporting frame structure for the gate;

a series of side-by-side stalls, each having respective forward and rear gates which are pivotally mounted to open and close, carried by the supporting frame structure;

hydraulic cylinders mounted to the frame adjacent each of the forward and rear gates, each cylinder having its piston secured to a respective gate in a position to open and close the gate on extension and retraction of the piston;

wheels pivotally mounted at or near each end of the frame structure of the gate supporting and guiding the frame structure for the gate;

hydraulically driven motors drivingly engaging the wheels;

steering means, including hydraulically operated cylinders secured to the frame structure, whose pistons are operatively attached to power means mounted on the frame operatively connected to and supplying hydraulic power to the hydraulic motors for the wheels and to the hydraulic cylinders for the steering means;

control means operatively connected to the hydraulic motors for controlling the movement and the speed of the wheels and connected to the hydraulic cylinders for controlling the direction of the wheels; and an operator's box positioned on one end of an adjustable boom secured to the frame structure for the gate, and control means in the box for opening and closing the gates and for moving and steering the frame structure of the gate.

10. An in-motion starting gate adapted to be positioned across a race track and then moved in its entirety along the length dimension of the track and removed from the track, comprising:

a supporting frame structure for the gate;

a series of side-by-side stalls, each having respective forward and rear gates which are pivotally mounted to open and close, carried by the supporting frame structure;

wheels pivotally mounted at or near each end of the frame structure of the gate supporting and guiding the frame structure for the gate;

hydraulically driven motors drivingly engaging the wheels;

steering means, including hydraulically operated cylinders secured to the frame structure, whose pistons are operatively attached to power means mounted on the frame operatively connected to and supplying hydraulic power to the hydraulic motors for the wheels and to the hydraulic cylinders for the steering means; and control means operatively connected to the hydraulic motors for controlling the movement and the speed of the wheels and connected to the hydraulic cylinders for controlling the direction of the wheels, wherein controls for each of the rear gates are positioned adjacent each of the rear gates to allow a person aiding a horse and rider to enter the stall to open and close the rear gate.

11. An in-motion starting gate adapted to be positioned across a race track and then moved in its entirety along the length dimension of the track and removed from the track, comprising:

a supporting frame structure for the gate;

a series of side-by-side stalls, each having respective forward and rear gates which are pivotally mounted to open and close, carried by the supporting frame structure;

wheels pivotally mounted at or near each end of the frame structure of the gate supporting and guiding the frame structure for the gate;

hydraulically driven motors drivingly engaging the wheels;

steering means, including hydraulically operated cylinders secured to the frame structure, whose pistons are operatively attached to power means mounted on the frame operatively connected to and supplying hydraulic power to the hydraulic motors for the wheels and to the hydraulic cylinders for the steering means; and control means operatively connected to the hydraulic motors for controlling the movement and the speed of the wheels and connected to the hydraulic cylinders for controlling the direction of the wheels, wherein the supporting frame structure includes respective end support members supporting the wheels, parallel arcuate members spanning the length dimension of the gate secured at their respective ends to the end support members, and cross-bracing extending between and connecting the arcuate members, the stalls suspended from the arcuate members.

12. The starting gate of claim 1 or 10, further including a platform at one end of the frame structure; an operator's box mounted on one end of an adjustable boom mounted on said platform; said control means for the hydraulic system located in said box, said platform being located over the wheels at one end of the frame structure to dispose the weight of the aforesaid elements primarily over said wheels and to minimize the weight on the wheels at the opposite end of the gate, thereby minimizing the imprint of said wheels on the track.

* * * * *